US005646582A

United States Patent [19]

Kawasaki

[11] Patent Number: 5,646,582

[45] Date of Patent: Jul. 8, 1997

[54] TRANSMISSION LINE SWITCH

[75] Inventor: Kenichi Kawasaki, Kanagawa, Japan

[73] Assignee: Sony Corporation, Tokyo, Japan

[21] Appl. No.: 546,954

[22] Filed: Oct. 23, 1995

[30] Foreign Application Priority Data

Nov. 4, 1994 [JP] Japan ..... 6-270844

[51] Int. Cl.[6] ..... H01P 1/15

[52] U.S. Cl. ..... 333/104; 333/24 C

[58] Field of Search ..... 333/101, 103, 333/104, 128, 24 C; 330/295, 286

[56] References Cited

U.S. PATENT DOCUMENTS 4,800,343 1/1989 Kinoshita ..... 333/24 C
5,023,935 6/1991 Vancraeynest ..... 333/104 X

FOREIGN PATENT DOCUMENTS 0350323 7/1989 European Pat. Off. .

OTHER PUBLICATIONS

Karlin et al., "Transistorized UHF Three–Way Switch", In *Soviet Invention Illustrated, Section II Electrical*, p. 13, Oct. 1969, Derwent Publications Ltd.: London (1970).

*Primary Examiner*—Paul Gensler
*Attorney, Agent, or Firm*—Jay H. Maioli

[57] ABSTRACT

The present invention is intended to prevent an unnecessary standing wave from being generated by simplifying a circuit in a transmission line switch to be used in a block-down converter for receiving, for example, satellite broadcasting. First and second amplifiers are adapted to be selectively switchable to an ON state to/from an OFF state and are arranged in first and second input lines and are respectively provided with a connection line for connecting the first and second input lines and a common output line. The connection line comprises a first transmission line 3 connected to an end part of the first input line, a second transmission line connected to an end part of the second input line and a third transmission line connected to an end part of the common output line. The first to third transmission lines are arranged in parallel to one another to transmit signals and form a DC block circuit adapted to selectively shut down a DC bias to the amplifiers.

4 Claims, 2 Drawing Sheets

TRANSMISSION LINE SWITCH

FIELD OF THE INVENTION

The present invention relates to a transmission line switch preferably adapted for use in a low-noise block-down converter for receiving, for example, satellite broadcasting waves.

BACKGROUND OF THE INVENTION

In some cases of current satellite broadcasting, different programs are transmitted with vertically polarized carriers and horizontally polarized carriers through a satellite. To enable a system to selectively receive two orthogonal; polarized signals, a transmission line switch is required for selecting one of the two orthogonal polarized signals from a receiving horn of a microwave antenna.

Accordingly, a low-noise block-down converter (LNB) is provided with the transmission line switch which controls the transmission lines so that only one of the input signals on one of two input lines is amplified and transmitted to an output line and the rest of the input signals are not transmitted to the output line.

FIG. 2 shows an example of a transmission line switch disclosed, for example, in Japanese Laid Open Patent H 2-63210 and is used to fill the above-described requirement. In other words, the transmission line switch disclosed in this reference is adapted so that two orthogonal polarized signals from the receiving horn of the microwave antenna are supplied respectively through input lines 1 and 2 and one of these signals is supplied to a common output line 4 at a connection point 10.

An amplifier la provided on the input line 1 preferably has an amplifier device Q1 formed with a high electron mobility transistor (HEMT) and matching circuits Ml and Ml' which are respectively arranged in the front and rear stages of the amplifier device Ql. Similarly, an amplifier 2*a* provided on the input line 2 has an amplifier device Q2 formed with a high electron mobility transistor (HEMT) and matching circuits M2 and M2' which are respectively arranged in the front and rear stages of the amplifier device Q2. Matching circuits Ml and Ml' and M2 and M2' are well known in the art and will not be described in further detail.

Bias lines 1*b* and 2*b* for respectively supplying a bias to the amplifiers 1*a* and 2*a* are connected to the output terminals of the amplifiers 1*a* and 2*a*. A DC block circuit 11*a* for making a DC potential (bias) stay in a transfer-blocked state is arranged between a connection point of the input line 1 with a bias line 1*b* and a connection point 10 of the input line 1 with the common output line 4. Similarly, a DC block circuit 11*b* for making a DC potential (bias) stay in a transfer-blocked state is arranged between a connection point of the input line 2 with a bias line 2*b* and a connection point 10 of the input line 2 with the common output line 4. Each of these DC block circuits 11*a* and 11*b* is generally formed with a capacity element or a connection line.

In the configuration shown in FIG. 2, the amplifier 1*a* or 1*b* is selectively turned on by the DC bias supplied from the bias line 1*b* or 2*b*. The selected amplifier 1*a* or 1*b* now in an ON state transfers a signal with a gain exceeding 1.

On the other hand, when the amplifier 1*a* or 1*b* is set to OFF, a length L of the line between the amplifier 1*a* and the connection point 10 and a length L of the line between the amplifier 2*a* and the connection point 10 are selected so that the impedance as the amplifier in the OFF state is viewed from the connection point 10 is high. Accordingly, one of the signals is transferred to the common output line 4 only through the amplifier remaining ON and the input signal in the amplifier remaining OFF is prevented from being transferred to the output line 4.

However, in the above-described transmission line switch, DC block circuits 11*a* and 11*b* should be respectively inserted between bias lines 1*b* and 2*b* and the connection point 10 with the common output line 4 to make the bias to be supplied to the amplifier 1*a* or 2*a* independent. These DC block circuits 11*a* and 11*b* are formed with a capacity element or a connection line and therefore provision of independent DC block circuits 11*a* and 11*b* may cause the circuits to be complicated and an unexpected standing wave to occur and this is one of the hindering factors to improvement of the block-down converter.

SUMMARY OF THE INVENTION

One object of the invention is to provide a transmission line switch which eliminates DC block circuits independently supplying a bias to respective amplifiers.

According to a first embodiment of the present invention, a transmission line switch has the first and second input lines and a connection line which connects the first and second input lines to a common output line. The first and second amplifiers being selectively switchable to ON and OFF states are respectively located on the first and second input lines.

The connection line has the first transmission line connected to an end part of the first input line, the second transmission line connected to an end part of the second input line and the third transmission line connected to an end part of the common output line. The first, second, and third transmission lines are arranged to be parallel to one another so as to hold DC potential thereof in a transfer-blocked state.

DETAILED DESCRIPTION OF THE INVENTION

Figure 1:
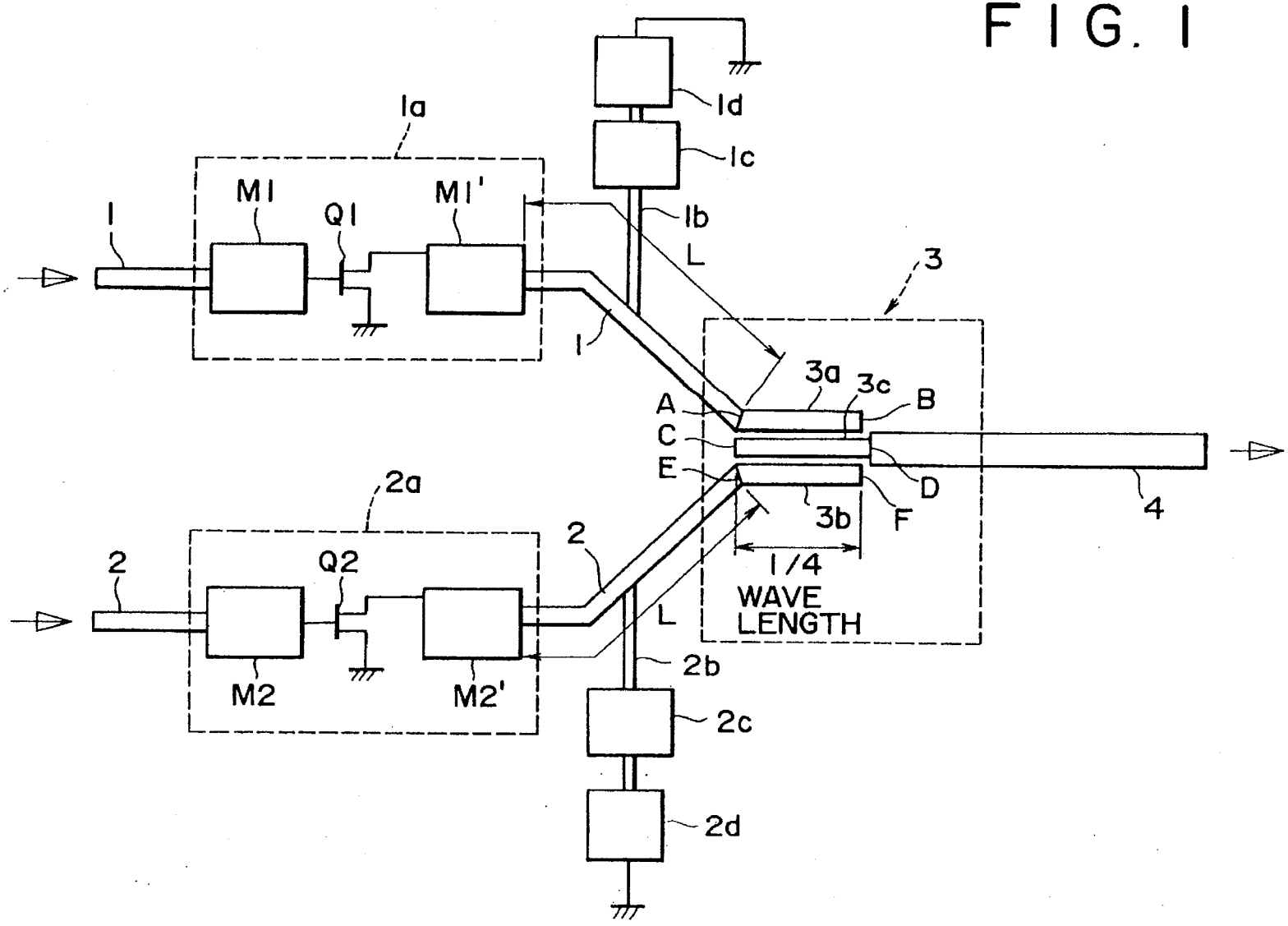
FIG. 1 is a block diagram showing an embodiment of a transmission line switch of the present invention.
Figure 2:
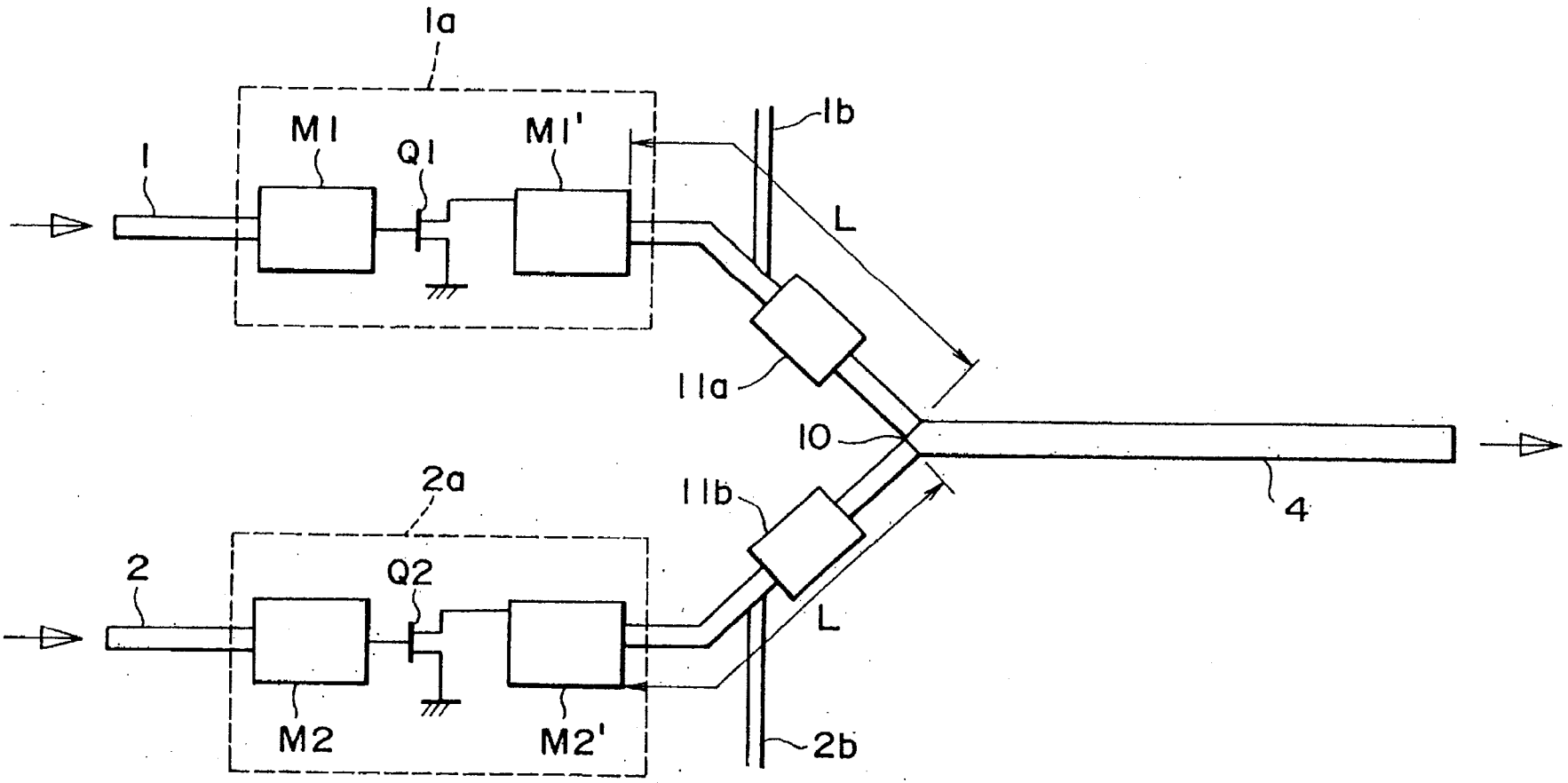
FIG. 2 is a block diagram showing an example of a conventional transmission line switch.

A transmission line switch according to the present invention is described in detail below referring to an embodiment shown in the drawings.

FIG. 1 is a block diagram showing a first embodiment in which the present invention is applied to a transmission line switch to be used in a block-down converter for receiving satellite broadcasting.

An output side of an amplifier 1*a* of a first input line l is connected with a first transmission line 3*a* forming a connection line 3 at a connection point A. Similarly, an output side of an amplifier 2*a* of a second input line 2 is connected with a second transmission line 3*b* forming a connection line 3 at a connection point E. In addition, a common output line 4 is connected with a third transmission line 3*c* forming a connection line 3 at a connection point D. The connection line 3 is also arranged so that the third transmission line 3*c* is arranged in the center of the first transmission line 3*a* and the second transmission line 3*b* which are arranged in parallel at both external sides of the connection line 3 with the DC potentials thereof held in a transfer-blocked state (DC blocked state) to one another.

The length of the first to third transmission lines 3*a* to 3*c* is determined to be a ¼ wavelength; An end part of first transmission line 3*a* opposite the end part to which the input line 1 is connected, is formed as an open end B; An end part of second transmission line 3*b* opposite the end part to which the input line 2 is connected, is formed as an open end F. An end part of third transmission line 3*c* opposite the end part to which a common output line 4 is connected, is formed as an open end C.

On the other hand, a bias line 1*b* is connected between the output side of the amplifier 1*a* of the first input line 1 and a connection line 3, and a band stop filter 1*c* and a termination circuit 1*d* are inserted into the bias line 1*b* and the other end part of bias line 1*b* is shorted to a reference potential point. Similarly, a bias line 2*b* is connected between the output side of the amplifier 2*a* of the second input line 2 and the connection line 3, and the band stop filter 2*c* and the termination circuit 2*d* are inserted into the bias line 2*b* and the other end part of bias line 2*b* is shorted to a reference potential point.

The band stop filters 1*c* and 2*c* are intended to prevent a signal of a desired frequency from being transmitted to the bias line while the termination circuits 1*d* and 2*d* respectively comprise a resistance element and a capacity element for blocking a DC voltage.

In a configuration shown in FIG. 1, a DC bias is selectively applied to the input line 1 or 2 through the bias lines 1*b* and 2*b* to make the transmission line switch perform a switching operation. For example, if the bias is applied to the input line 1 through the bias line 1*b*, the bias is applied to the first amplifier 1*a* and the amplifier 1*a* is turned on. The amplifier 1*a* transfers the signal with a carrier of a 10 GHz band arriving through a waveguide to the connection line 3 with a gain exceeding 1.

On the other hand, the first to third transmission lines 3*a* to 3*c* are arranged in parallel to maintain the DC block state in the connection line 3 and therefore the supply of the bias to the other amplifier 2*a* is shut off and the second amplifier 2*a* is held OFF.

In this case, an amplitude of a reflection coefficient when the amplifier 2*a* held in the OFF state is viewed from the output side is approximate to 1. Accordingly, an impedance as the amplifier 2*a* in the OFF state is viewed from the connection point E can be high by appropriately selecting the length L of the input line 2 between the amplifier 2*a* and the connection line 3.

The length of the second transmission line 3*b* which forms the connection line 3 is approximately ¼ of the wavelength of a desired frequency and the other end part is formed as the open end F and therefore the transmission line 3*b* is equivalent to a ¼ wavelength line with both open ends in terms of the desired frequency. The other end part of the third transmission line 3*c* is formed as the open end C and therefore the second transmission line 3*b* and the third transmission line 3*c* are not connected with the desired frequency. In other words, the input line 2 held in the OFF state cannot be viewed with the desired frequency from the common output line 4. Accordingly, the signal on the input line 2 held OFF is not transmitted to the common output line 4.

On the other hand, since the amplitude of the reflection coefficient when the amplifier 1*a* held ON is viewed from the output side is generally small, the first transmission line 3*a* and the third transmission line 3*c* operate with the desired frequency as a satisfactory ¼ wavelength coupler. Accordingly, the signal on the input line 1 held ON is transmitted to the common output line 4.

Though the transmission line switch of this configuration satisfactorily performs the switching operation with the desired frequency as described above, there is a frequency with which the amplitude of the reflection coefficient is increased by the effect of the standing wave between the amplifier 2*a* held On and the open end F of the second transmission line 3*b* with a frequency other than the desired frequency when the connection line 3 is viewed from the ON side amplifier 1*a*.

Since the stability of an amplifying element deteriorates at such frequency with which the reflection coefficient is increased, it is difficult to form a wide band amplifier. A band of the band stop filter 1*c* on the bias line for preventing the signal of the desired frequency from being transmitted to the bias line 1*b* is selected so that the band is set to be wider than required. The impedance as the bias line 1*b* is viewed from the amplifier 1*a* held in the ON state is arranged so that the signal from the input line 1 goes through the bias line 1*b* to the termination circuit 1*d* except for the desired band. Thereby, a load condition of the output side of the amplifier 1*a* held ON is improved and the band of the amplifier 1*a* is widened.

The above describes the operation in a case that the first amplifier 1*a* is held ON and the second amplifier is held OFF. However, it is easily understood that, if the second amplifier 2*a* is held ON and the first amplifier 1*a* is held OFF, the input port is changed over and the same effect as the above is obtained.

As shown from the above description, the first input line, the second input line and the common output line are connected with the connection line and the transmission lines which form this connection line are arranged to be parallel to one another with the DC potential held in the transfer-blocked state (DC block) and therefore the DC block circuit need not be provided in the first and second input lines as in the prior art. Accordingly, it is possible to provide the transmission line switch in which the circuit configuration is simplified and an unnecessary standing wave will not be caused.

According to other aspects of the transmission line switch, the other end parts of the respective transmission lines connected to the first input line, the second input line and the common output line are formed as open ends and therefore the transmission lines which form the connection line are equivalent to the ¼ wavelength line with both open ends at the desired frequency. Connection and non-connection between the transmission lines is controlled based on ON/OFF operation of the amplifiers provided in the first input line and the second input line and therefore a gain loss on the transmission line switch can be reduced.

According to another aspect of the transmission line switch, the length of the first to third transmission lines which are arranged in parallel to one another and form the connection line, is set to ¼ wavelength and therefore a satisfactory ¼ wavelength coupler can be formed between the transmission lines at the amplifier held ON. In this case, the connection line has the characteristics of a band pass filter, thereby, signals except the desired band is gone to the termination circuit.

According to the transmission line switch, since a band stop filter and a termination circuit are inserted into the bias lines for supplying the bias to the respective amplifiers, the load condition of the output side of the amplifier held ON can be controlled by appropriately selecting the filtering characteristics of the band stop filter and consequently the band of the amplifier can be widened.

What is claimed is:

1. A transmission line switch comprising:

first and second input lines on which first and second amplifiers which are selectively switchable to ON and OFF states are respectively located; and a connection line which connects said first and second input lines with a common output line, wherein said connection line comprises a first transmission line connected to an end part of said first input line, a second transmission line connected to an end part of said second input line and a third transmission line connected to an end part of said common output line, and said first to third transmission lines are arranged to be parallel to one another with a DC potential thereof held in a transfer-blocked state, wherein said first input line between said first amplifier and said connection line is connected with a first bias line for supplying a bias to said first amplifier and a first band stop filter and a first termination circuit are connected to said first bias line.

2. A transmission line switch according to claim 1, wherein another end part opposite an end part to which the input line in said first transmission line is connected, another end part opposite an end part to which the input line in said second transmission line is connected, and another end part opposite an end part to which the common output line in said third transmission line is connected are respectively formed as open ends.

3. A transmission line switch according to claim 2, wherein a length of each of the first to third transmission lines which are arranged in parallel to one another to form said connection line is set to ¼ wavelength of a desired frequency of operation.

4. A transmission line switch according to claim 1, wherein said second input line between said second amplifier and said connection line is connected with a second bias line for supplying a bias to said second amplifier and a second band stop filter and a second termination circuit are connected to said second bias line.

* * * * *